United States Patent [19]

Leiter et al.

[11] Patent Number: 4,844,744

[45] Date of Patent: Jul. 4, 1989

[54] LIQUID, PHOSPHATE-FREE SINGLE PHASE DEGREASING COMPOSITIONS

[75] Inventors: Herbert Leiter, Monheim; Dieter Brodalla, Duesseldorf; Harald Wennemann, Erkrath; Frantisek Jost, Duesseldorf; Andreas Buhl, Hilden, all of Fed. Rep. of Germany

[73] Assignee: Henkel Kommanditgesellschaft auf Aktien, Duesseldorf, Fed. Rep. of Germany

[21] Appl. No.: 169,709

[22] Filed: Mar. 18, 1988

[30] Foreign Application Priority Data

Mar. 19, 1987 [DE] Fed. Rep. of Germany ..... 3708938

[51] Int. Cl.[4] ..... C11D 3/10; C11D 1/10; C11D 3/37

[52] U.S. Cl. ..... 134/40; 252/156; 252/174.14; 252/174.19; 252/174.24; 252/546; 252/547; 252/DIG. 2; 252/DIG. 14

[58] Field of Search ..... 252/547, 546, 156, 174.24, 252/174.19, DIG. 14, 174.14, 547, 528; 134/40

[56] References Cited

U.S. PATENT DOCUMENTS

| | | | |
|---|---|---|---|
| 3,687,858 | 8/1972 | Geisler et al. | 252/156 |
| 3,951,827 | 4/1976 | Burroughs et al. | 252/8.55 |
| 4,048,121 | 9/1977 | Chang | 252/527 |
| 4,081,395 | 3/1978 | Talley | 252/106 |
| 4,093,566 | 6/1978 | MacNamara et al. | 252/527 |
| 4,212,761 | 7/1980 | Ciaccio | 252/174.12 |
| 4,457,322 | 7/1984 | Rubin et al. | 134/2 |
| 4,521,332 | 6/1985 | Milora | 252/527 |
| 4,528,039 | 7/1985 | Rubin et al. | 134/2 |
| 4,540,444 | 9/1985 | Kelly | 134/3 |
| 4,547,243 | 10/1985 | Brody | 156/164 |
| 4,599,116 | 7/1986 | King et al. | 134/2 |
| 4,717,497 | 1/1988 | Yasuhara et al. | 252/135 |
| 4,756,846 | 7/1988 | Matsuura et al. | 252/156 |

FOREIGN PATENT DOCUMENTS

| | | |
|---|---|---|
| 119641 | 9/1984 | European Pat. Off. . |
| 181673 | 5/1985 | European Pat. Off. . |
| 1937841 | 3/1970 | Fed. Rep. of Germany . |
| 3600415 | 7/1987 | Fed. Rep. of Germany . |
| 2520373 | 7/1983 | France . |
| 1293440 | 10/1972 | United Kingdom . |
| 2148942 | 6/1985 | United Kingdom . |

OTHER PUBLICATIONS

Shell Chemical Company (SC: 68-86) published Jul. 1986 entitled "KRATON TM, Thermoplastic Rubber, Typical Properties 1986."

Chemical Abstract 108:28,564j; Chemical Abstract, 97:168,697j or 104:56,125j; Markanova et al., Chem. Abst. 106:71,684u

*Primary Examiner*—Prince E. Willis

*Attorney, Agent, or Firm*—Ernest G. Szoke; Wayne C. Jaeschke; Norvell E. Wisdom, Jr.

[57] ABSTRACT

Liquid phosphate-free single phase degreasing compositions for aluminum surfaces containing one or more builders, sequestrants and surfactants in aqueous alkaline solution, particularly containing alkali metal and/or ammonium carbonate, alkali metal and/or ammonium hydrogen carbonate, one or more acrylic polymers, optionally one or more other complexing agents which complement or partly replace the acrylic polymers, one or more anionic or nonionic surfactants, optionally other active substances and/or auxiliaries of the type normally used in degreasing compositions and water.

33 Claims, 4 Drawing Sheets

FIG. I

LIQUID, PHOSPHATE-FREE SINGLE PHASE DEGREASING COMPOSITIONS

BACKGROUND OF THE INVENTION

1. Field of the Invention

This invention relates to liquid, phosphate-free single phase degreasing compositions which may be used for cleaning aluminum surfaces.

2. Statement of Related Art

The application of inorganic or organic coatings to metal surfaces, which has recently acquired increasing significance in efforts to improve corrosion prevention or to obtain decorative effects, requires careful cleaning of the metal surfaces beforehand in preparation for the application of the coatings. Metal surfaces are normally treated with highly alkaline cleaning solutions with more or less complete removal of soil, particularly grease.

Cleaning with strongly alkaline cleaning solutions has always been problematical in the case of aluminum surfaces or metal surfaces containing aluminum in addition to other metals, because aluminum is known to be extremely sensitive to strongly alkaline aqueous solutions. At extremely high pH values, undesirably large quantities of aluminum are dissolved from the metal surfaces in the form of alkaline aluminate complex salts. Accordingly, where aluminum surfaces are cleaned with alkaline cleaning preparations, it has always been necessary to strike a compromise between the degreasing performance of the cleaning composition on the one hand and the undesirable erosion of metal from the aluminum surfaces on the other hand. Aqueous systems in which builders suitable as buffers are used are normally employed for cleaning aluminum surfaces. In the present context and in the context of the following description and in the claims, "builders" are understood to be compounds which are active as buffers and which enhance the cleaning effect of surfactants. Builders which have been successfully used in the prior art for the cleaning of aluminum surfaces include, in particular, borate salts such as borax, which are used in combination with alkali metal orthophosphates or alkali metal salts of condensed phosphates and which developed an adequate degreasing effect without excessive quantities of metal being eroded from the aluminum surface.

The principal disadvantage of known formulations of this type is that the corresponding borate salts are poorly soluble in water. The effect of this is that problems are repeatedly encountered in the preparation of the known solutions because multiphase systems are formed during dosing of the (generally powder) compositions in process water. In addition, the condensed phosphates normally used as sequestering (complexing) agents are gradually hydrolyzed in aqueous solution, losing their complexing properties in the process. In addition, the phosphates formed in the known solution and in the wastewater are also ecologically undesirable and have to be gradually replaced by other compounds to be able to prevent the eutrophication of surface waters.

The cleaning preparations previously proposed in the prior art are unsuitable for solving the problems involved in the cleaning of aluminum surfaces for a number of reasons. For example, U.S. Pat. No. 4,521,332 describes aqueous compositions for the cleaning of metal surfaces which are strongly alkaline and which contain large quantities of sodium hydroxide as well as an alkali metal carbonate dispersed in polyacrylic acid. Cleaning dispersions such as these are unsuitable for the degreasing of aluminum surfaces simple because of their high alkalinity.

U.S. Pat. No. 4,528,039 describes compositions intended for the degreasing of aluminum surfaces which, in addition to sodium carbonate, contain sodium silicate as a builder. Surface active agents and other additives known from the prior art are also present in the compositions. However, compositions such as these cannot be used in dissolved form for the degreasing of aluminum surfaces because, as powders, they have to be introduced into the aqueous phase in a certain quantity before application. Complete dissolution or rather homogeneous dispersion of the compositions in the aqueous phase is not guaranteed, at least on an industrial scale. In addition, compositions of the type in question are attended by the disadvantage that automatic dosing of powders is not readily possible. Because of this, liquid formulations are preferred for industrial application.

According to H. -G. Germscheid "Untersuchungsmethoden bei der Entfettung" in "Gavanotechnik" 67, 215 (1976), surfactants play an important part in the degreasing and cleaning of metal surfaces insofar as they displace the film of grease adhering to the metal surfaces and thus enable the metal surfaces to be more or less completely degreased. Degreasing in the adsence of surfactants is not regarded as possible in this publication. In particular, it is shown by the results of experiments that the effect of the surfactants can be enhanced by the effect of other constituents, particularly builders, in cleaning preparations. The test results described in the above article also provide quantitative proof of the synergistic effect of builders and surfactants.

BRIEF DESCRIPTION OF THE INVENTION

Other than in the operating examples, or where otherwise indicated, all numbers expressing quantities of ingredients or reaction conditions used herein are to be understood as modified in all instances by the term "about".

The present invention provides new degreasing compositions for aluminum surfaces which can be made up in liquid form and which are at least comparable with, if not better than, known degreasing compositions, that is they enable an aluminum surface to be completely degreased in a single operation. In this connection, it had to be borne in mind that, to increase their stability in storage, liquid degreasing compositions of the type in question should not be present in two-phase form, for example in the form of suspensions or dispersions. This means that all the components involved have to be completely soluble. In addition, degreasing compositions of this type have to be substantially free from phosphate, i.e. free both from (a) condensed phosphates as active components, which in state-of-the-art compositions are hydrolyzed in aqueous phase and thus lose their activity, particularly their sequestering activity, and (b) from orthophosphate, to avoid adverse ecological effects, primarily the eutrophication of surface waters, from the outset. In addition, the inventive degreasing compositions lend themselves to automatic dosing and, subsequently, to ready dispersion in the working solution, which is best guaranteed by a liquid composition.

The present invention therefore affords liquid, phosphatefree single phase degreasing compositions for aluminum surfaces containing one or more builders, sequestrants and surfactants in aqueous alkaline solution, which also comprise: (A) alkali metal carbonate and/or ammonium carbonate; (B) alkali metal hydrogen carbonate and/or ammonium hydrogen carbonate; (C) one or more complexing agents which are (1) acrylic polymers, (2) complexing agents other than acrylic polymers, or (3) a mixture thereof; (D) one or more anionic or nonionic surfactants; (E) optionally one or more active substances and/or auxiliaries of the type normally used in degreasing compositions other than the foregoing; and (F) water.

Both here and in the following description and in the claims, "single phase degreasing compositions" for aluminum surfaces are understood to be degreasing compositions which are present in the form of solutions in which all the components are clearly, i.e. isotropically, dissolved, rather than in the form of suspensions or dispersions. Single phase degreasing compositions such as these have a major advantage over compositions known from the prior art in that they show much greater stability in storage. This is because no sedimentation of essential components or any phase separation is observed during storage, particularly under extreme conditions, so that a substantially uniform concentration of all the active substances in the concentrates can be guaranteed, even over relatively long periods. This make the inventive concentrates easier to handle by the user in the preparation of the working solutions and leads to rapid dispersion of the active ingredients in the working solutions, even on an industrial scale.

DETAILED DESCRIPTION OF THE INVENTION

Figure 1:
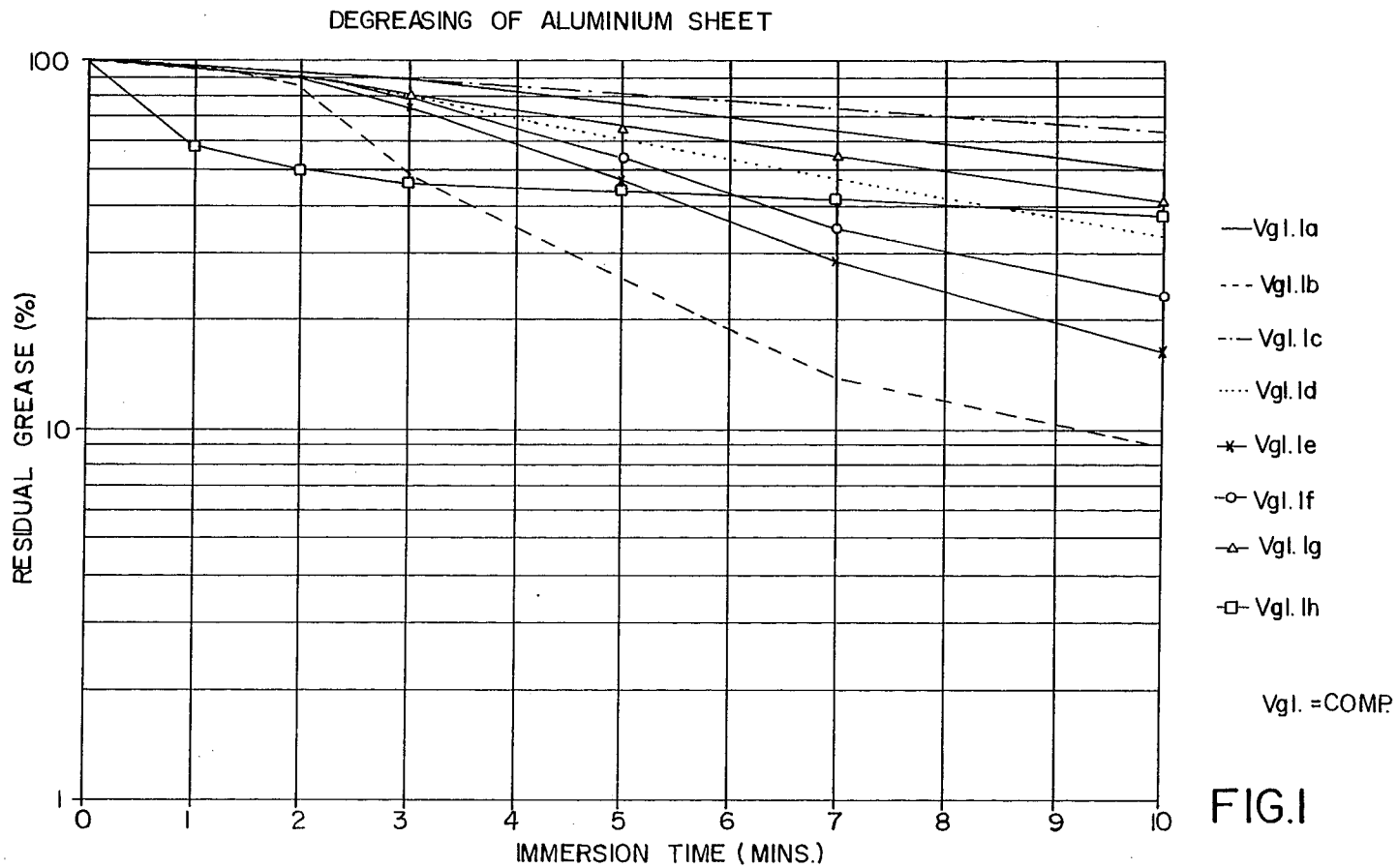
FIG. 1 is a graph comparing the quantities of residual grease remaining after cleaning processes according to the prior art (Comparison Example 1).

The inventive compositions contain ingredients (A) and (B) as essential builders, i.e. buffers. Suitable representatives of the groups of compounds included in these categories are carbonates and hydrogen carbonates corresponding to general formulae (I) and (II) below $$MM'CO_3 \quad (I)$$

$$MHCO_3 \quad (II)$$

in which M and M' may be the same or different and are lithium, sodium, potassium or ammonium of the formula $NHR^1R^2R^3$, where $R^1$, $R^2$, and $R^2$ may be the same or different and are hydrogen, $C_{1-6}$ alkyl or hydroxy-$C_{1-6}$-alkylene.

Suitable carbonates (A) include: lithium carbonate; sodium carbonate; potassium carbonate; ammonium carbonate ($R^1=R^2=R^3=H$); mono-, di or tri-alkyl ammonium carbonates in which the alkyl radicals are methyl, ethyl, propyl, butyl, pentyl or hexyl; and mono-, di-, or tri-alkanolammonium carbonates, in which the alkanol radicals are methanol, ethanol, propanol, butanol, pentanol or hexanol.

Suitable hydrogen carbonates (B) include: lithium hydrogen carbonate; sodium hydrogen carbonate; potassium hydrogen carbonate; ammonium hydrogen carbonate ($R^1=R^2=R^3=H$); mono-, di-, or tri-alkyl ammonium hydrogen carbonates in which the alkyl radicals are methyl, ethyl, propyl, butyl, pentyl, or hexyl; and mono-, di-, and tri- alkanolammonium carbonates, in which the alkanol radicals are methanol, ethanol, propanol, butanol, pentanol or hexanol. Both in (A) the ammonium carbonates and (B) the ammonium hydrogen carbonates, any alkyl radicals and/or alkanol radicals present may be linear or branched, linear radicals being preferred.

Within the entire group of compounds (A) and (B) mentioned, sodium carbonate and sodium hydrogen carbonate, potassium carbonate and potassium hydrogen carbonate and triethanolammonium carbonate and triethanolammonium hydrogen carbonate are preferred. It is possible in each inventive composition to use one or more of (A) and one or more of (B).

The two classes of compounds comprising ingredients (A) and (B) are known to have a high buffer capacity and, in this property, may replace the borate (borax) used as builder in state-of-the-art compositions. In this regard, ingredients (A) and (B) afford the advantage that they show extremely good solubility in water and hence contribute to rapid, effective and uniform dispersion in the concentrates. In addition, they establish the alkaline pH value required for cleaning compositions of this type without the addition of alkali metal hydroxides being necessary to establish an alkaline pH. Such addition gave rise to the disadvantage known in the prior art that, in view of the large excess of hydroxyl ions, alkali metal hydroxoaluminates were formed on the aluminum surfaces and part of the aluminum surfaces was eroded in this complex form during the cleaning process. Where alkali metal and/or ammonium carbonate and alkali metal and/or ammonium hydrogen carbonate are used in combination with one another, there is no sign of increased erosion of the aluminum surfaces, notwithstanding that an excellent degreasing effect on the aluminum surfaces is obtained at moderately alkaline pH.

According to the invention, the degreasing compositions preferably contain sodium and/or potassium and /or triethanolammonium carbonate and sodium and/or potassium and/or triethanolammonium hydrogen carbonate. Ingredients (A) and (B) should be present minimally in a combined builder/buffer effective amount, preferably in a quantitative ratio of 0.1–3:1, a quantitative ratio of 0.5:1 being preferred. In the preparation of the single phase degreasing compositions, the compounds are normally used in the form of their hydrates which, even after brief contact with water, dissolve completely in the aqueous phase without any need for prolonged stirring.

According to the invention, the liquid single-phase degreasing compositions for aluminum surfaces contain (C) one or more complexing agents which are acrylic polymers or non-acrylic polymer complexing agents in addition to the carbonate salts mentioned. In the inventive compositions "acrylic polymers" are understood to be polymers of acrylic acid and/or methacrylic acid or copolymers of acrylic acid and/or methacrylic acid with another monomer containing olefinic double bonds, as well as the watersoluble salts of such polymers or copolymers. Particularly advantageous water soluble salts are the alkali metal and/or ammonium salts of the polymers or copolymers mentioned, in which the salt forming cation is one from the group defined above for M in general formula (I). Among these water soluble salts, the sodium, potassium and/or triethanolammonium salts may be used with particular advantage by virtue of their ready availability. "Other (non-acrylic polymer) complexing agents" are understood to be complexing agents known from the prior art, as exemplified subsequently.

Compounds which are polymers of acrylic acid, methacrylic acid, sodium acrylate, sodium methacrylate, copolymers of acrylic acid and/or methacrylic acid and maleic acid and the sodium salt of acrylic acid- and/or methacrylic acid-maleic acid copolymers may be used with particular advantage as acrylic polymers in the degreasing compositions according to the invention. The polymers mentioned are known to have sequestering properties, i.e. they are capable of acting as complexing agents for metal ions. Within the group mentioned, those polymers which have an average molecular weight of 30,000 to 150,000 or the sodium and/or triethanolammonium salts thereof are active with particular advantage in this regard. These compounds have the advantage over the phosphates and polyphosphates used in the prior art in that not only are they stable to hydrolysis in aqueous solution, but they also do not lead to the eutrophication of surface waters and hence cause no ecological damage while achieving a comparable sequestering effect.

Instead of or together with the acrylic polymers mentioned, one or more other complexing agents may optionally be used in the inventive degreasing composition. Although the decreasing compositions according to the invention containing only acrylic polymers as ingredient (C), (i.e. with no additions of other identified complexing agents), may be diluted to working solutions with tapwater of standard hardness without any deposits being precipitated, it may nevertheless be desirable under certain conditions, (for example where it is intended to use particularly hard water for dilution), to add other such complexing agents to the inventive degreasing compositions, or to replace the acrylics entirely. Useful other complexing agents include: citric acid, gluconic acid, acetaldehyde glyoxylic acid polyacetal, ethylenediamine tetraacetic acid (EDTA), nitrilotriacetate (MTA), and the alkali metal and/or ammonium salts thereof. The sodium, potassium and/or triethanolammonium salts are preferably used as complexing agents together with or instead of the acrylic polymers by virtue of their excellent solubility in water. Accordingly, sodium citrate, sodium gluconate or the sodium salt of acetaldehyde glyoxylic acid polyacetal and/or the corresponding potassium or triethanolammonium salts are suitable for complementing or replacing the acrylic polymer(s) in the inventive compositions. The compounds mentioned themselves contribute to a sequestering, i.e. complexing, effect in conjunction with the acrylic polymers. Although, in principle, one or more acrylic polymers and other complexing agents from the groups mentioned may be used in admixture in any ratios by weight, it is preferred according to the invention to use the acrylic polymers and the other complexing agents (when the other complexing agents are present), in a weight ratio of 1: up to 1, preferably 1: up to 0.25.

As ingredient (D) the inventive compositions contain one or more anionic or nonionic surfactants as further essential components. The surfactants present are preferably adducts of ethylene oxide and/or propylene oxide with fatty alcohols, $C_{6-22}$-alkylphenols, fatty amines, fatty-alkyl-derivatized ether amines, unsaturated, epoxidized and, optionally, ring-opened (with monohydric alcohols) and saturated fatty acids containing 6 to 22 carbon atoms in the linear or branched alkyl radicals, and from the group of alkyl benzenesulfonic acids, alkane sulfonic acids, alkyl sulfates and alkyl ether sulfates and water-soluble salts thereof, preferably alkali metal and/or ammonium salts, containing 6 to 22 carbon atoms in the alkyl radical. In adducts such as these, an average of 1 to 20 mol of the particular alkylene oxide is added onto 1 mol of the particular fatty derivative, i.e. fatty alcohol, alkylphenol, fatty amine, ether amine or fatty acid or fatty acid derivatives.

Accordingly, suitable surfactants include adducts of ethylene oxide and/or propylene oxide with fatty alcohols from the group comprising octanol, nonanol, decanol, undecanol, dodecanol, tridecanol, tetradecanol, pentadecanol, hexadecanol, heptadecanol, octadecanol, nonadecanol, eicosanol, uneicosanol, or docosanol, preference normally being attributed to the linear fatty alcohols and also to mixtures of such alcohols which are inexpensively obtainable on an industrial scale from natural fats or oils and mixtures thereof. For example, adducts of ethylene oxide and/or propylene oxide with tallow fatty alcohols, coconut fatty alcohols and/or comparable fatty alcohol mixtures of native origin may be used with particular advantage.

Adducts of alkylphenols containing 6 to 22 carbon atoms in the alkyl radical may also be used as the surfactant component in accordance with the invention. Accordingly, ethylene oxide and/or propylene oxide may be added to the above-mentioned quantitative ratios onto alkylphenols containing the following groups as the alkyl chain: hexyl, heptyl, octyl, nonyl, decyl, undecyl, dodecyl, tridecyl, tetradecyl, pentadecyl, hexadecyl, heptadecyl, octdecyl, nonadecyl, eicosyl, uneicosyl or docosyl. Both the linear and the branched alkyl radicals are suitable, although the linear alkylphenols are particularly preferred for forming the adducts because they are more readily obtainable from natural fats and oils. Mixtures of such adducts of ethylene oxide and/or propylene oxide with alkylphenols may also be used as surfactants.

Adducts of ethylene oxide and/or propylene oxide with fatty amines from the group comprising octylamine, nonylamine, decylamine, undecylamine, dodecylamine, tridecylamine, tetradecylamine, pentadecylamine, hexadecylamine, heptadecylamine, octadecylamine, nonadecylamine, eicosylamine, uneicosylamine and docosylamine or even mixtures of such fatty amines may also be used in the singlephase degreasing compositions according to the invention. As with the fatty alcohols, the linear fatty amines from the group mentioned and mixtures of such fatty amines are particularly suitable for the formation of suitable adducts because they may be inexpensively obtained in large quantities from natural fats and oils.

Other surfactants components suitable for use in accordance with the invention are adducts of ethylene oxide and/or propylene oxide with fatty-alkyl-derived ether amines. These ether amines are tertiary amines containing ether groups with at least one alkyl polyglycol ether group at the aminonitrogen atom. Suitable fatty alkyl radicals are the $C_{6-22}$ alkyl radicals which were mentioned above in connection with the alkylphenols. The number of E.O. or P.O. groups is between 2 and 20. Corresponding compounds are described in German patent document No. 35 04 242. In addition to individual compounds, mixtures of the adducts mentioned may also be used. Thus, both the length of the fatty alkyl groups and also the number of recurring alkoxy units in the adduct formed may vary over a more or less wide range.

The same applies to the adducts of ethylene oxide and/or propylene oxide with fatty acids which may also be used as surfactant component in accordance with the invention. Fatty acids such as these may be both unsaturated fatty acids containing 8 to 22 carbon atoms in the linear or branched alkyl radicals.

Accordingly, the surfactant component which may be used includes adducts of ethylene oxide and/or propylene oxide with caprylic acid, pelargonic acid, capric acid, undecanoic acid, lauric acid, tridecanoic acid, myristic acid, pentadecanoic acid, palmitic acid, margaric acid, stearic acid, nonadecanoic acid, arachic acid, uneicosanoic acid, behenic acid and the corresponding unsaturated carboxylic acids occurring in the starting products of native fats and oils normally used.

Similarly, it is possible to use adducts of ethylene oxide and/or propylene oxide with epoxidized unsaturated carboxylic acids and with epoxidized carboxylic acids ring-opened with monohydric alcohols after epoxidation as surfactant component.

One feature common to all the surfactants from the abovementioned groups of adducts, which are suitable for use in the degreasing compositions according to the invention for aluminum surfaces, is than an average of 1 to 20 mol of the particular alkylene oxide is added onto 1 mol of the particular fatty derivative, i.e. fatty alcohol, fatty amine or the particular fatty acid. It is possible to use mixtures of ethylene oxide and propylene oxide for forming adducts such as these and thus to prepare adducts with the fatty derivatives mentioned which are both ethoxylated and propoxylated, the sequence of the ethoxy and propoxy groups being immaterial. A preferred number of such ethoxy and/or propoxy moieties is in the range from 5 to 15. In view of the more or less statistical ethoxylation or propoxylation reaction, mixtures of these adducts which contain a more or less wide range of fatty derivatives alkoxylated to different extents are normally used as surfactant components.

In addition to the adducts mentioned above, $C_{6-22}$ alkyl benzenesulfonic acids, $C_{6-22}$ alkane sulfonic acids, $C_{6-22}$ alkyl sulfates and $C_{6-22}$ alkyl ether sulfates and water soluble salts thereof, preferably alkali metal and/or ammonium salts and, more preferably, sodium and/or triethanolammonium salts, also may be used as surfactants in the inventive degreasing compositions. The alkyl radicals, which may be linear or branched, derive from the group mentioned above in connection with the alkylphenols. Once again individual compounds or mixtures may be used.

One or more surfactants having a HLB value in the range from 10 to 20 are preferably used as surfactants component (D). Within the group of surfactants having a HLB value in the range mentioned, those having an HLB value of from 13 to 17 are preferred. Within this group, the nonionic surfactants and, of these, the linear and/or branched fatty alcohol ethoxylates have proved to be particularly suitable because they ensure adequate solubility in water for a good cleaning effect by virtue of their balanced ratio of the hydrophilic to lipophilic part of the molecule. As already mentioned, both individual surfactants and also mixtures of different surfactants are used as essential surfactant components in the degreasing compositions according to the invention, providing they satisfy the requirements stated above.

In practice, it has proven to be particularly effective to use two surfactants which may be employed individually or even in admixture with one another in the inventive degreasing compositions. The surfactants in question are the adduct of an average 12 mol ethylene oxide (EO) with coconut amine (fatty amine containing from 12 to 18 carbon atoms) and the adduct of 10 mol EO with a fatty acid epoxide containing 12 to 14 carbon atoms which has been reacted with ethylene glycol. These two surfactants may be used both individually and also in admixture, mixtures containing the two surfactants in a weight ratio of 1:1 being preferred. Excellent cleaning effects can be obtained on aluminum surfaces with a degreasing composition containing these surfactants either individually or in admixture as surfactant component. In particular, grease residues can be almost completely removed from aluminum surfaces in only a short time with a single treatment.

In addition to the components mentioned, it is also possible, if desired, to add (E) other active substances and/or auxiliaries of the type normally used in degreasing compositions. These other active substances and/or auxiliaries can afford further advantages in terms of practical application. They include solubilizers which can contribute toward producing liquid single phase degreasing compositions showing long term stability in storage. If desired, solubilizers known from the prior art may be used for this purpose, including urea, ethanol, isopropanol, propylene glycol, cumene sulfonate, 2-ethyl hexylsulfate or octylsulfate. The compounds mentioned may be used either individually or in combination with one another. However, their total content in the degreasing compositions according to the invention should remain relatively low, if in fact they are used at all, and never above 10% by weight.

As mentioned above, very little erosion of aluminum from the metal surfaces is observed with the degreasing compositions according to the invention. In order further to reduce the already minimal erosion of aluminum, corrosion inhibitors may, if desired, be added to the compositions according to the invention without any adverse effect on their advantageous properties. Suitable corrosion inhibitors include chromium salts and/or silicates as known from the prior art. They may be added to the composition according to the invention in quantities of 0 to 5% by weight.

To be able to blend the components mentioned into a liquid degreasing composition, the compositions according to the invention also contain (F) water. In this regard, it is possible with suitable blending to use deionized water, which may be regarded as a preferred embodiment. However, the components mentioned may also be introduced into normal process water or tapwater. The degreasing effect of the compositions according to the invention is not affected.

In one particularly preferred embodiment, the liquid, phosphate-free single phase degreasing compositions according to the invention for aluminum surfaces contain (A) alkali metal and/or ammonium carbonate and (B) alkali metal and/or ammonium hydrogen carbonate in a total quantity of 1 to 20% by weight, these percentages and also the following percentages being based on the total weight of the decreasing compositions. The two carbonates are preferably present in a total quantity of 5 to 13% by weight. According to the invention, (C) the complexing agents according to the invention (one or more compounds from the group mentioned above may be used) are used in a total quantity of 1 to 10% by weight and preferably in a quantity of 5 to 8% by weight. The anionic or nonionic surfactant(s) (D) mentioned are present in total quantities of 0.1 to 10% by weight and preferably in total quantities of 1 to 3% by weight, while (E) the optional active substances and auxiliaries of the type normally used in degreasing compositions are present where required in total quantities of 0 to 18% by weight and preferably in total quantities of 1 to 10% by weight. The other essential component according to the invention, (F) water, is present in the liquid single-phase degreasing compositions according to the invention for aluminum surfaces in such a quantity that it balances the total quantity of all the other components to 100% by weight.

By virtue of the content of alkali metal and/or ammonium carbonate and alkali metal and/or ammonium hydrogen carbonate and, optionally, other alkaline components of the degreasing compositions according to the invention, the pH of the aqueous solutions is normally 8.5 to 12.5, preferably 9.0 to 9.8. With degreasing compositions such as these, aluminum surfaces can be degreased much more effectively in most cases compared with the prior art without any more erosion of aluminum from the treated, i.e. degreased, surfaces than was normally the case with known compositions.

In every case, the degreasing compositions according to the invention are obtained in the form of clear isotropic concentrate solutions which show excellent stability in storage, even under extreme storage conditions, and are not affected by inhomogeneities. They are normally diluted with water by the user in a ratio of concentrate to water of 1:20–40 and are brought into contact with the aluminum surfaces in the form of such dilute working solutions. Both deionized water and also tapwater or process water may readily be used without affecting the advantages of the degreasing compositions according to the invention. The dilution process does not involve any problems. By virtue of the fact that they are blended as liquids, the degreasing compositions according to the invention are rapidly dispersed in water without any need for the laborious stirring or dissolving processes necessitated by the powder-form concentrates known from the prior art.

The invention is illustrated by the following Examples.

The degreasing effect of the liquid single-phase degreasing compositions according to the invention was tested by the method described in H. -G. Germscheid "Untersuchungsmethoden bei der Entfettung" in "Galvanotechnik" 67, 215 et seq. (1976), in which the aluminum surfaces to be tested are treated with a test soil containing $^{14}C$-labelled fats and oils. The test soil had the following composition:

| | |
|---|---|
| ($^{14}C$) glyceryl trioleate: | 0.78 mg |
| ($^{14}C$) glyceryl tripalmitate: | 0.53 mg |
| ($^{14}C$) glyceryl tristearate: | 10.56 mg |
| lard oil A: | 488.12 mg |

500 mg of the test soil were taken up in 100 ml toluene. The specific activity of this test soil was $7.2\times10^5$ dpm/mg test soil.

The aluminum plates were precleaned before coating with the above test soil. To this end, a 3% aqueous solution having the composition described below in Comparison Example 3 was heated to 70 to 80° C. in a glass beaker. Aluminum plates measuring 150 mm×50 mm×1 mm were completely immersed in the heated solution for about 30 seconds and then rinsed in running deionized water (flow rate: 6 l/min, temperature 24° C.). Before they were predried with paper towels, the aluminum plates were dried at room temperature for at least 12 h.

Using a pipette, 500 μg test soil (corresponding to 100 μl of the toluene solution prepared as described above) were spread over the precleaned aluminum plates in a circle measuring approximately 20 $cm^2$. The solvent was evaporated over a period of 18 to 36 h at room temperature. Before each series of measurements, the zero decay rate on ungreased cleaned aluminum plates was measured using a Berthold LB 6210 H duothroughflow counting tube. The initial activity ($A_O$) of the greased aluminum plates was then determined.

This determination was followed by the cleaning process.

The residual grease content P was measured in accordance with the following equation:

$$P = \frac{A_i - NR}{A_o - NR} \times 100\ (\%)$$

in which

NR=zero rate, $A_O$=initial activity, $A_i$=residual activity and

P=residual grease content in percent.

COMPARISON EXAMPLE 1

The aluminum plates prepared as described above and coated with labelled test soil were vertically immersed in cleaning solutions containing the aqueous solutions shown below with different builder combinations. The temperatures of the solutions were 50° C. After immersion times of 1, 2, 3, 5, 7 and 10 minutes, the aluminum plates were removed from the cleaning solutions. They were then hung up for 3 minutes to dry and the residual activity subsequently determined as described above using the duothroughflow counting tube. The determinations were always carried out as double or triple determinations.

The aqueous solutions had the following compositions, the solid components separately being dissolved in 1 liter deionized water:

(a) 10.0 g soda; 16.3 g sodium hydrogen carbonate; 7.1 g sodium tripolyphosphate; pH value: 9.54.

(b) 4.5 g soda; 15.0 g borax; 9.0. g sodium tripolyphosphate; pH value 9.53.

(c) 0.9 soda; 15.0 g sodium tripolyphosphate; pH value 9.52.

(d) 10.0 g soda; 20.0 g sodium hydrogen carbonate; 7.0 g of the sodium salt of acetaldehyde glyoxylic acid polyacetal; pH value 9.54.

(e) 10.0 g soda, 23.0 g sodium hydrogen carbonate; 7.0 g sodium citrate; pH value 9.40.

(f) 10.0 g soda; 19.0 sodium hydrogen carbonate; 7.0 g sodium gluconate pH value 9.48.

(g) 10.0 g soda; 16.8 g sodium hydrogen carbonate; 7.0 g of sodium maleic acid/acrylic acid copolymer (Sokalan® CPS, a product of BASF); pH value 9.47.

(h) 5.5 g soda; 15.0 g copolymeric acrylic acid, molecular weight 30,000 to 60,000 (Sandoclean® PTE, a product of Sandoz); pH value 9.47.

The quantities of residual grease (in %) remaining after these cleaning processes as a function of the immersion time are shown in FIG. 1.

Result

The cleaning effect of all the described solutions (a) to (h) was relatively poor which may be attributed to the fact that all the solutions were surfactant-free. It is known from the prior art that surfactant-free degreasing solutions can have only a relatively poor degreasing effect.

COMPARISON EXAMPLE 2

Aluminum plates were immersed in aqueous solutions having the compositions shown below in the same way and at the same temperatures as in Comparison Example 1, the components mentioned separately being dissolved in 1 liter deionixed water:

(a) 1.5 g of an adduct of 12 mol ethylene oxide with coconut amine (alkylamine containing 8 to 18 C-atoms in the alkyl radical); pH value 9.50.

(b) 1.3 g of the adduct of solution (a); 0.2 g alkyl benzenesulfonate; pH value 9.30.

(c) 0.75 g of the adduct of solution (a); 0.75 g of an adduct of 5 E.O. with a fatty alcohol containing 12 to 18 C-atoms in the alkyl radical, pH value 9.56, (d) 1.5 g of an adduct of 10 E.O. with a $C_{12-14}$ epoxide reacted with ethylene glycol; pH value 9.45.

(e) 0.75 g of the adduct of solution (a); 0.75 g of the adduct of solution (d); pH value 9.50.

(f) 1.5 g of an adduct of approximately 14 E.O. with a tallow fatty alcohol (fatty alcohol containing 16 to 18 C-atoms in the alkyl radical); pH value 9.48.

Figure 2:
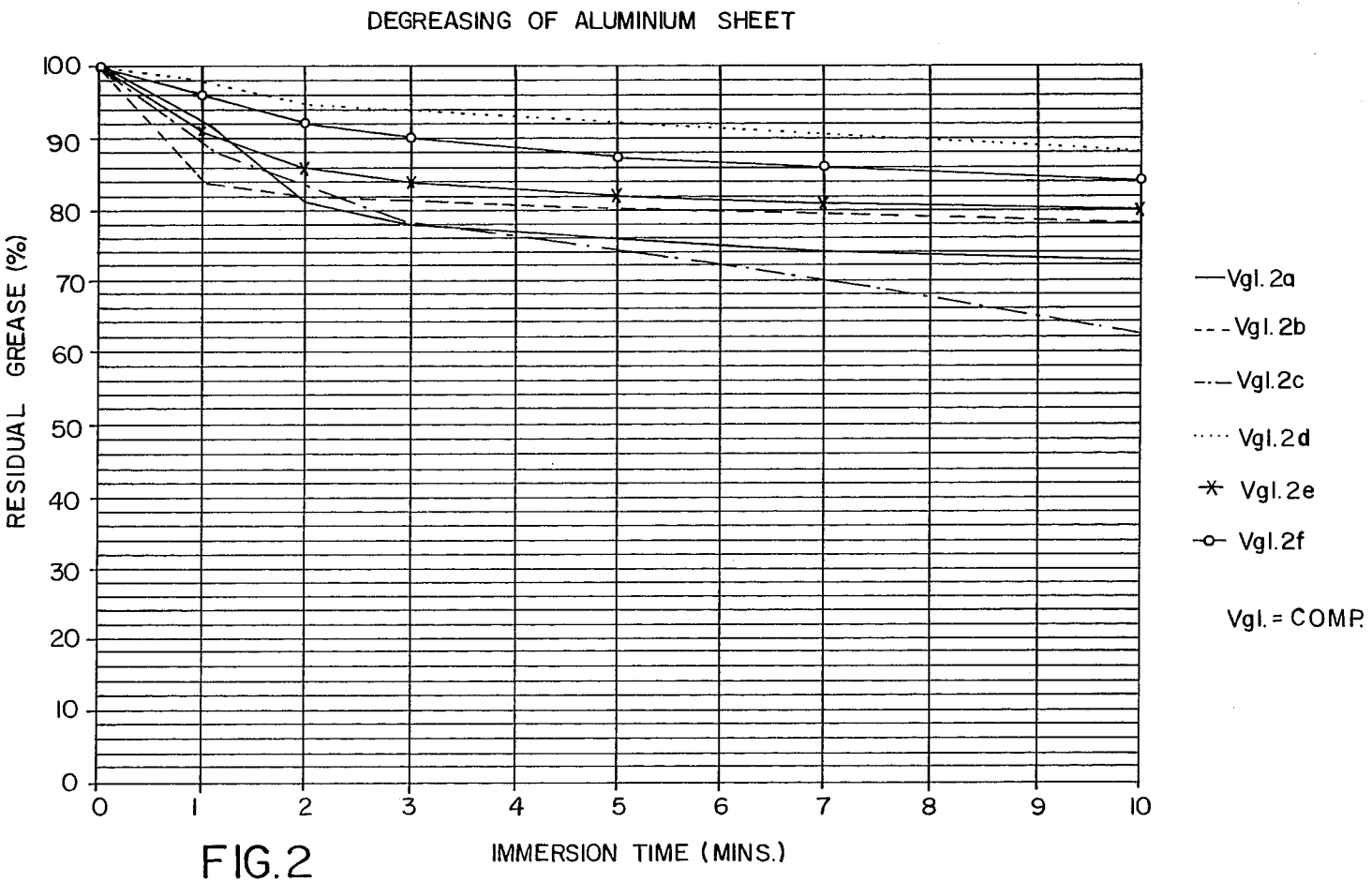
FIG. 2 is a graph comparing the quantities of residual grease as a function of immersion time (Comparison Example 2).

The residual grease contents (in %) as a function of the immersion time in solutions (a) to (f) are shown in FIG. 2.

Result

Even the builder-free degreasing solutions containing one or more surfactants had a relatively poor degreasing effect, despite prolonged immersion at temperatures of 50° C. In no case could more than 40% of the test soil be removed.

EXAMPLE 1

Aluminum plates precleaned and coated with test soil as described above were vertically immersed at 40° C. in a degreasing solution containing the following components in 1 liter deionized water; 5.0 g soda; 9.42 g sodium hydrogen carbonate; 7.0 g of sodium maleic acid/acrylic acid copolymer ("Sokalan" CPS, a product of BASF) and 1.5 g of an adduct of 12 E.O. with coconut amine (alkylamine mixture, 8 to 18 carbon atoms in the alkyl radical).

The pH value of the aqueous degreasing composition was 9.49.

Figure 3:
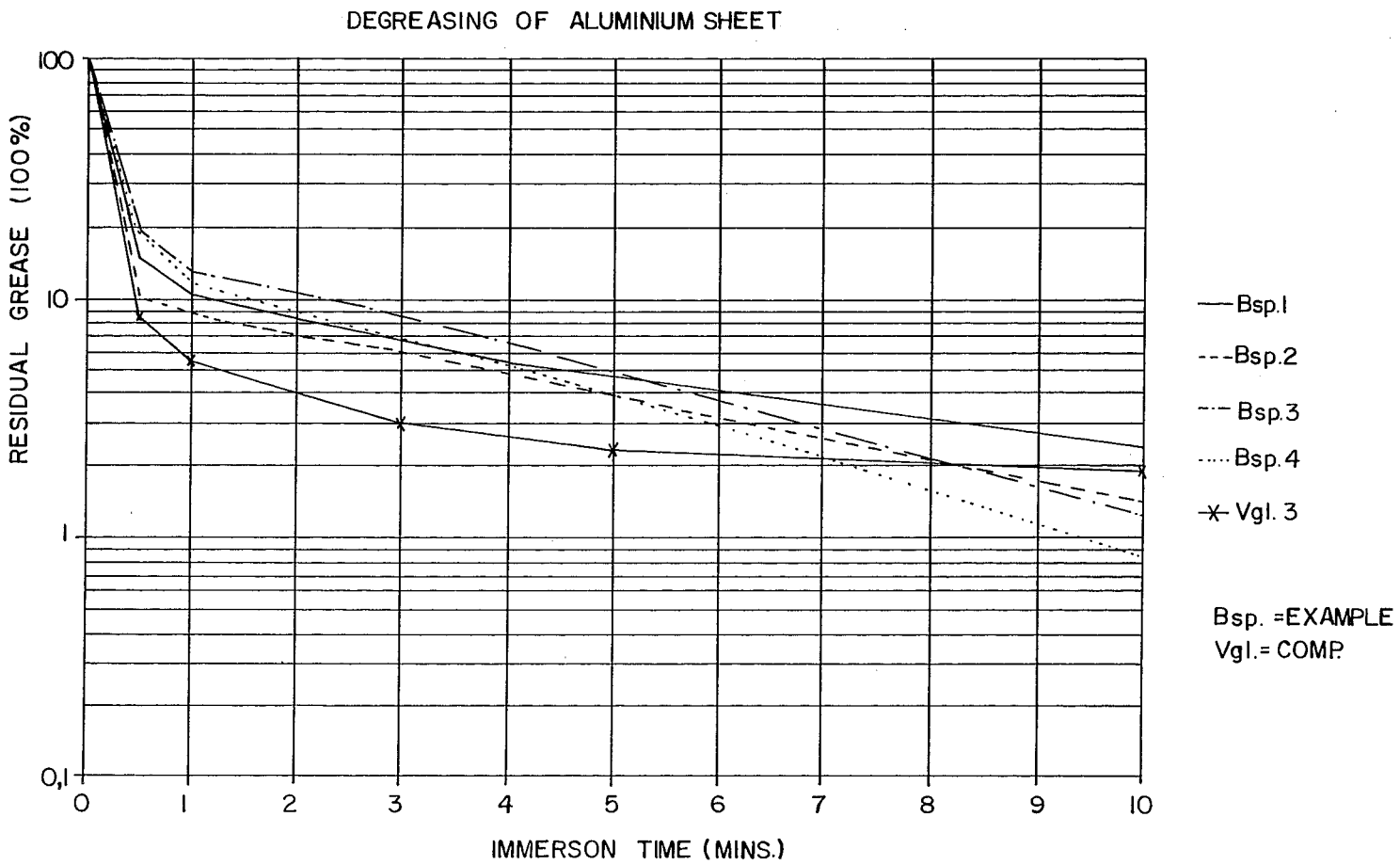
FIG. 3 is a graph comparing the degreasing results of Examples 1 to 4 according to this invention with Comparison Example 3.

The aluminum plates were removed from the aqueous solution after 0.5, 1, 3, 5 and 10 minutes and then rinsed for 10 seconds in running deionized water (flow rate: 3 l/minutes; temperature 24° C.). The aluminum plates were then hung up to dry for 3 minutes and the residual activity subsequently measured. A triple determination was carried out. The residual grease content was determined in accordance with the above equation. The results are shown in FIG. 3.

Result

The degreasing solution having the composition according to the invention showed a distinctly better degreasing effect, even at 40° C., than the solutions described in Comparison Examples 1 and 2. This is clear proof of the better degreasing effect of the degreasing compositions according to the invention compared with comparable compositions from the prior art.

EXAMPLES 2 to 4

The aluminum plates were immersed as in Example 1 in aqueous solutions containing the following components in 1 liter deionized water:

Example 2: 5.0 g soda; 10.66 g sodium hydrogen carbonate; 7.0 g of the sodium salt of acetaldehyde glyoxylic acid polyacetal; 1.5 g of the adduct of 12 E.O. with coconut amine; pH value 9.50.

Example 3: 5.0 g soda; 9.85 g sodium hydrogen carbonate; 7.0 g sodium citrate; 1.5 g of the adduct of 12 E.O. with coconut amine; pH value 9.50.

Example 4: 5.0 g soda; 10.2 g sodium hydrogen carbonate; 7.0 g sodium gluconate; 1.5 g of the adduct of 12 E.O. with coconut amine; pH value 9.50.

The degreasing results are also shown in FIG. 3.

Result:

As in Example 1, the degreasing compositions of Examples 2 to 4, which have the composition according to the invention, show a distinctly better degreasing effect, even at 40° C., than known state-of-the-art degreasing compositions.

COMPARISON EXAMPLE 3

The aluminum plates were treated as in Example 1 with a commercially obtainable degreasing solution for aluminum surfaces which contained the following components in 1 liter deionized water:

4.5 g soda; 15.0 borax; 9.0 sodium tripolyphosphate; 1.5 g of an adduct of 12 E.O. with coconut amine; pH value: 9.47.

The degreasing results also are shown in FIG. 3.

Result

Although the above degreasing composition shows satisfactory cleaning results, it cannot be stored for long periods because of its content of condensed phosphates, since tripolyphosphates are hydrolyzed in aqueous solution in the event of prolonged storage and thus lose their sequestering properties. In addition, laborious stirring or mixing processes were necessary to dissolve the borax-containing powder-form product in water. This is regarded as a serious disadvantage.

EXAMPLES 5 to 8

The aluminum plates were brought into contact as in Example 1 with solutions containing the following components in 1 liter deionized water:

Example 5: 5.0 g soda; 5.4 g sodium hydrogen carbonate; 7.0 g copolymeric acrylic acid (molecular weight 30,000 to 60,000) ("Sandoclean" PTE, a product of Sandoz; cf. Sandoz product information sheets); 1.5 g of an adduct of 12 E.O. with coconut amine as surfactant component. The pH value was 9.52.

Example 6: Composition as in Example 5, except that only 0.75 g instead of 1.5 g of the E.O.-coconut amine adduct was used; instead, 0.75 g of an adduct of 5 E.O. with a $C_{12}$–$C_{18}$ fatty alcohol was added. The pH was 9.55.

Example 7: Composition as in Example 5, except that only 0.75 g instead of 1.5 g of the E.O.-coconut amine adduct was used; in addition, 0.75 g of an adduct of 10 E.O. with a $C_{12-14}$ opoxide which had been reacted with ethylene glycol was added.

Example 8: Composition as in Example 5, except that 1.5 g of a surfactant mixture of 80% by weight of an adduct of 5 E.O. with a $C_{12-18}$ fatty alcohol and 20% by weight of an ether amine was used instead of the E.O.-coconut amine adduct. The pH value was 9.53.

Figure 4:
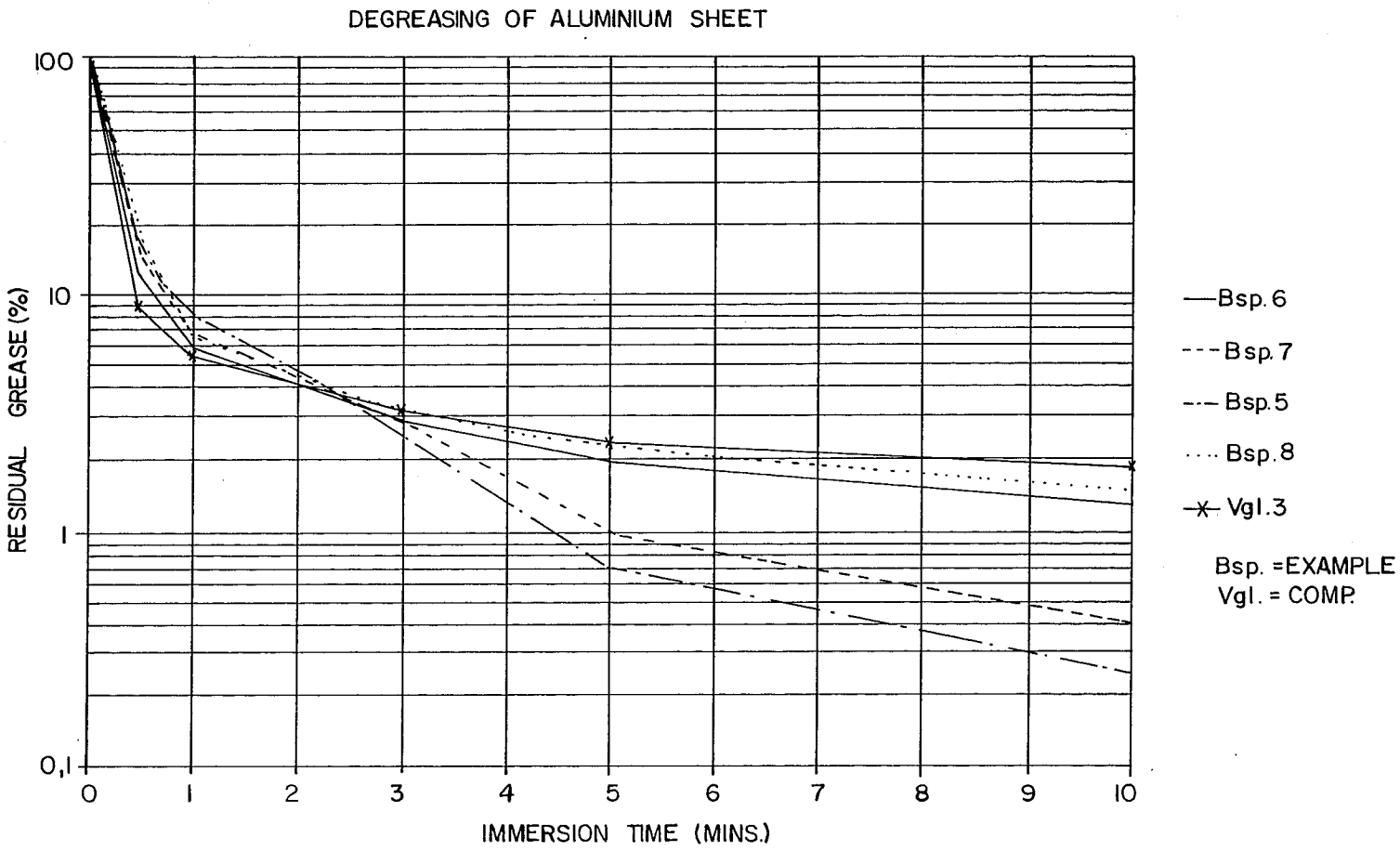
FIG. 4 is a graph comparing the degreasing results of Examples 5 to 8 according to this invention with Comparison Example 3.

The results are shown in FIG. 4.

Result

The degreasing compositions of inventive Examples 5 to 8 showed a distinctly improved degreasing effect compared with the prior art.

We claim:

1. A liquid, phosphate-free, single phase degreasing composition for aluminum surfaces, comprising:

(A) alkali metal or ammonium carbonate;

(B) alkali metal hydrogen or ammonium hydrogen carbonate, present jointly with component (A) in a builder effective amount;

(C) complexing agent present in a complexing effective amount;

(D) anionic or nonionic surfactant, present in a surfactant effective amount;

(F) water.

2. The composition of claim 1 wherein (A) comprises a compound of the formula $$MM'CO_3 \quad (I)$$

wherein M and M' individually are lithium, sodium, potassium or $NHR^1R^2R^3$ wherein $R^1$, $R^2$ and $R^3$ individually are H, $C_{1-6}$ alkyl, or hydroxy-$C_{1-6}$-alkylene.

3. The composition of claim 1 wherein (B) comprises a compound of the formula $$MHCO_3 \quad (II)$$

wherein M is lithium, sodium, potassium, or $NHR^1R^2R^3$ wherein $R^1$, $R^2$, and $R^3$ individually are H, $C_{1-6}$ alkyl, or hydroxy —$C_{1-6}$-alkylene.

4. The composition of claim 2 wherein (B) comprises a compound of the formula $$MHCO_3 \quad (II)$$

wherein M is lithium, sodium, potassium, or $NHR^1R^2R^3$ wherein $R^1$, $R^2$, and $R^3$ individually are H, $C_{1-6}$ alkyl, or hydroxy —$C_{1-6}$ -alkylene.

5. The composition of claim 1 wherein (A) comprises at least one of sodium carbonate, potassium carbonate, or triethylammonium carbonate and (B) is at least one of sodium hydrogen carbonate, potassium hydrogen carbonate, or triethylammonium carbonate.

6. The composition of claim 5 wherein (A) and (B) are present in a ratio of about 0.1–3:1.

7. The composition of claim 5 wherein (A) and (B) are present in a ratio of about 0.5:1.0.

8. The composition of claim 1 wherein (C) comprises at least an acrylic polymer.

9. The composition of claim 1 wherein (C) comprises at least one polymer of: acrylic acid; methacrylic acid; or copolymers of acrylic acid and/or methacrylic acid with another monomer containing olefinic double bonds; or a water soluble salt thereof.

10. The composition of claim 4 wherein (C) comprises at least one polymer of: acrylic acid; methacrylic acid; or copolymers of acrylic acid and/or methacrylic acid with another monomer containing olefinic double bonds; or a water soluble salt thereof.

11. The composition of claim 1 wherein (C) comprises at least one polymer of: acrylic acid; methacrylic acid; sodium acrylate; sodium methacrylate; triethanolammonium acrylate; triethanolammonium methacrylate; or copolymers of acrylic and/or methacrylic acid and maleic acid or their sodium, potassium, or triethanolammonium salts.

12. The composition of claim 5 wherein (C) comprises at least one polymer of: acrylic acid; methacrylic acid; sodium acrylate; sodium methacrylate; triethanolammonium acrylate; triethanolammonium methacrylate; or copolymers of acrylic and/or methacrylic acid and maleic acid or their sodium, potassium, or triethanolammonium salts.

13. The composition of claim 1 wherein (C) comprises at least one of: citric acid; gluconic acid; acetaldehyde glyoxylic acid polyacetal; ethylenediamine tetraacetic acid; nitrilotriacetate; or the alkali metal or ammonium salts thereof.

14. The composition of claim 9 wherein (C) further comprises at least one of: citric acid; gluconic acid; acetaldehyde glyoxylic acid polyacetal; ethylenediamine tetraacetic acid; nitrilotriacetate; or the alkali metal or ammonium salts thereof.

15. The composition of claim 10 wherein (C) further comprises at least one of: citric acid; gluconic acid; acetaldehyde glyoxylic acid polyacetal; ethylenediamine tetraacetic acid; nitrilotriacetate; or the alkali metal or ammonium salts thereof.

16. The composition of claim 11 wherein (C) further comprises at least one of: citric acid; gluconic acid; acetaldehyde glyoxylic acid polyacetal; ethylenediamine tetraacetic acid; nitrilotriacetate; or the alkali metal or ammonium salts thereof.

17. The composition of claim 12 wherein (C) further comprises at least one of: citric acid; gluconic acid; acetaldehyde glyoxylic acid polyacetal; ethylenediamine tetraacetic acid; nitrilotriacetate; or the alkali metal or ammonium salts thereof.

18. The composition of claim 1 wherein (D) comprises (1) at least one of: adducts of 1 to 20 mols of ethylene oxide and/or propylene oxide with: fatty alcohols; $C_{6-22}$ alkylphenols; fatty amines; fatty alcohol-derived ether amines; epoxidized unsaturated $C_{6-22}$ carboxylic acids; epoxidized $C_{6-22}$ carboxylic acids ring-opened with monohydric alcohols; saturated or unsaturated $C_{6-22}$ carboxylic acids; and/or (2) at least one of: $C_{6-22}$ alkyl benzenesulfonic acids, $C_{6-22}$ alkane sulfonic acids, $C_{6-22}$ alkyl sulfates, $C_{6-22}$ alkyl ether sulfates, or the alkali metal or ammonium salts thereof.

19. The composition of claim 1 wherein (D) was an HLB value of 10 to 20.

20. The composition of claim 1 wherein (D) has an HLB value of 13 to 17.

21. The composition of claim 18 wherein (D) has an HLB value of 13 to 17.

22. The composition of claim 1 wherein (D) comprises: one or more nonionic fatty alcohol ethoxylates.

23. The composition of claim 1 wherein (D) comprises the adduct of 12 E.O. with coconut amine or the adduct of 10 E.O. with a $C_{12-24}$ fatty acid epoxide ring-opened with ethylene glycol or a mixture thereof in about a 1:1 ratio.

24. The composition of claim 10 wherein (D) comprises (1) at least one of: adducts of 1 to 20 mols of ethylene oxide and/or propylene oxide with: fatty alcohols; $C_{6-22}$ alkylphenols; fatty amines; fatty alcohol-derived ether amines; epoxidized unsaturated $C_{6-22}$ carboxylic acids; epoxidized $C_{6-22}$ carboxylic acids ring-opened with monohydric alcohols; saturated or unsaturated $C_{6-22}$ carboxylic acids; and/or (2) at least one of: $C_{6-22}$ alkyl benzenesulfonic acids, $C_{6-22}$ alkane sulfonic acids, $C_{6-22}$ alkyl sulfates, .$C_{6-22}$ alkyl ether sulfates, or the alkali metal or ammonium salts thereof.

25. The composition of claim 12 wherein (D) comprises (1) at least one of: adducts of 1 to 20 mols of ethylene oxide and/or propylene oxide with: fatty alcohols; $C_{6-22}$ alkylphenols; fatty amines; fatty alcohol-derived ether amines; epoxidized unsaturated $C_{6-22}$ carboxylic acids; epoxidized $C_{6-22}$ carboxylic acids ring-opened with monohydric alcohols; saturated or unsaturated $C_{6-22}$ carboxylic acids; and/or (2) at least one of: $C_{6-22}$ alkyl benzenesulfonic acids, $C_{6-22}$ alkane sulfonic acids, $C_{6-22}$ alkyl sulfates, $C_{6-22}$ alkyl ether sulfates, or the alkali metal or ammonium salts thereof.

26. The composition of claim 13 wherein (D) comprises: one or more nonionic fatty alcohol ethoxylates.

27. The composition of claim 18 wherein (D) comprises the adduct of 12 E.O. with coconut amine or the adduct of 10 E.O. with a $C_{12-14}$ fatty acid epoxide ring-opened with ethylene glycol or a mixture thereof in about a 1:1 ratio.

28. The composition of claim 1 wherein:

(A) and (B) are together present in about 1 to 20% by weight;

(C) is present in about 1–20% by weight;

(D) is present in about 0.1–10% by weight;

(D) may be present in 0 to about 18% by weight; and (F) water is present q.s. to 100%;

all based upon the total weight of the compostiion.

29. The composition of claim 24 wherein:

(A) and (B) are together present in about 1 to 20% weight;

(C) is present in about 1–10% by weight;

(D) is present in about 0.1–10% by weight;

(E) may be present in 0 to about 18% by weight; and (F) water is present q.s. to 100%;

all based upon the total weight of the composition.

30. The composition of claim 1 wherein (A) and (B) are together present in about 5–13% by weight, (C) is present in 5–8% by weight;

(D) is present in 1–3% by weight;

(E) is present in 1–10% by weight; and (F) is present q.s. to 100%;

all based upon the total weight of the composition.

31. The composition of claim 26 wherein (A) and (B) are together present in about 5–13% by weight, (C) is present in 5–8% by weight;

(D) is present in 1–3% by weight;

(E) is present in 1–10% by weight; and (F) is present q.s. to 100%;

all based upon the total weight of the composition.

32. The composition of claim 1 having a pH of about 8.5–12.5.

33. A method for degreasing aluminum surfaces comprising applying the composition of claim 1 in a diluted form in a degreasing effective concentration, for a degreasing effective time, and at a degreasing effective temperature, and then removing said composition from said surface.

* * * * *

UNITED STATES PATENT AND TRADEMARK OFFICE

CERTIFICATE OF CORRECTION

PATENT NO. : 4,844,744

DATED : July 4, 1989

INVENTOR(S) : Herbert Leiter, Dieter Brodalla, Harald Wennemann, Frantisek Jost, and Andreas Buhl It is certified that error appears in the above-identified patent and that said Letters Patent is hereby corrected as shown below:

In Claim 28, at Col. 16, line 1, delete "(D)" and add --(E)--.

Signed and Sealed this

Seventeenth Day of April, 1990

*Attest:*

HARRY F. MANBECK, JR.

*Attesting Officer*

*Commissioner of Patents and Trademarks*